US008879954B2

(12) United States Patent
Nonaka et al.

(10) Patent No.: US 8,879,954 B2
(45) Date of Patent: Nov. 4, 2014

(54) CARTRIDGE WITH MEMBER FOR FIXING A MEMBER-TO-BE-ENERGIZED

(71) Applicant: Canon Kabushiki Kaisha, Tokyo (JP)

(72) Inventors: Fumito Nonaka, Mishima (JP); Yuichi Fukui, Yokosuka (JP); Tachio Kawai, Odawara (JP); Shunsuke Uratani, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 29 days.

(21) Appl. No.: 13/706,687

(22) Filed: Dec. 6, 2012

(65) Prior Publication Data

US 2013/0177334 A1 Jul. 11, 2013

(30) Foreign Application Priority Data

Dec. 9, 2011 (JP) ..... 2011-270184
Nov. 5, 2012 (JP) ..... 2012-243467

(51) Int. Cl.

| | |
|---|---|
| ***G03G 15/08*** | (2006.01) |
| ***G03G 21/18*** | (2006.01) |
| ***G03G 15/00*** | (2006.01) |
| ***G03G 21/00*** | (2006.01) |

(52) U.S. Cl.

CPC ..... *G03G 15/80* (2013.01); *G03G 21/1814* (2013.01); *G03G 21/181* (2013.01); *G03G 21/0023* (2013.01)

USPC ..... 399/111; 399/284; 399/351

(58) Field of Classification Search

USPC ..... 399/111, 119, 110, 274, 278, 350, 351, 399/107

See application file for complete search history.

(56) References Cited

U.S. PATENT DOCUMENTS

| | | | |
|---|---|---|---|
| 5,903,803 | A | 5/1999 | Kawai et al. |
| 5,937,237 | A | 8/1999 | Nonaka et al. |
| 6,055,406 | A | 4/2000 | Kawai et al. |
| 6,101,348 | A | 8/2000 | Nomaka et al. |
| 6,115,567 | A | 9/2000 | Kawai et al. |
| 6,128,454 | A | 10/2000 | Kawai et al. |
| 6,163,665 | A | 12/2000 | Watanabe et al. |
| 6,175,706 | B1 | 1/2001 | Watanabe et al. |
| 6,226,478 | B1 | 5/2001 | Watanabe et al. |
| 6,240,266 | B1 | 5/2001 | Watanabe et al. |

(Continued)

FOREIGN PATENT DOCUMENTS

| | | |
|---|---|---|
| JP | 2000-112318 | 4/2000 |
| JP | 2008-292557 | 12/2008 |

OTHER PUBLICATIONS

International Search Report and Written Opinion of the International Searching Authority in International Patent Application No. PCT/JP2012/082270, mailed Mar. 6, 2013.

*Primary Examiner* — Sophia S Chen
(74) *Attorney, Agent, or Firm* — Fitzpatrick, Cella, Harper & Scinto

(57) ABSTRACT

A cartridge detachably mountable to a main assembly of an image forming apparatus includes: a frame; a member-to-be-energized; a fixing member, having electroconductivity, for fixing the member-to-be-energized to the frame, wherein the fixing member is electrically connected with the member-to-be-energized; a recessed portion, provided on the frame, where a part of the fixing member enters; and a molded resin portion formed by injecting a melted electroconductive resin material into the recessed portion, wherein when the cartridge is mounted in the main assembly, the molded resin portion electrically connects the fixing member with an energizing portion provided in the main assembly.

10 Claims, 8 Drawing Sheets

(56) References Cited

U.S. PATENT DOCUMENTS

| | | | | |
|---|---|---|---|---|
| 6,336,018 | B1 | 1/2002 | Kawai et al. | |
| 6,349,188 | B1 | 2/2002 | Kawai et al. | |
| 6,381,430 | B1 | 4/2002 | Yokomori et al. | |
| 6,463,232 | B1 | 10/2002 | Kawai et al. | |
| 6,480,687 | B1 | 11/2002 | Kawai et al. | |
| 6,496,667 | B2 | 12/2002 | Shiratori et al. | |
| 6,501,926 | B1 | 12/2002 | Watanabe et al. | |
| 6,501,927 | B1 | 12/2002 | Watanabe et al. | |
| 6,560,422 | B2 | 5/2003 | Kanno et al. | |
| 6,735,403 | B2 | 5/2004 | Kanno et al. | |
| 6,738,588 | B2 | 5/2004 | Yokomori et al. | |
| 6,826,380 | B2 | 11/2004 | Karakama et al. | |
| 6,922,534 | B2 | 7/2005 | Goto et al. | |
| 6,947,686 | B2 | 9/2005 | Kawai et al. | |
| 6,968,142 | B2 | 11/2005 | Arimitsu et al. | |
| 7,016,662 | B1 | 3/2006 | Manku et al. | |
| 7,027,754 | B2 | 4/2006 | Harada et al. | |
| 7,046,942 | B2 | 5/2006 | Arimitsu et al. | |
| 7,082,276 | B2 | 7/2006 | Karakama et al. | |
| 7,085,516 | B2 | 8/2006 | Kawai et al. | |
| 7,110,703 | B2 | 9/2006 | Uratani et al. | |
| 7,130,560 | B2 | 10/2006 | Kawai et al. | |
| 7,233,752 | B2 | 6/2007 | Harada et al. | |
| 7,257,353 | B2 | 8/2007 | Kawai et al. | |
| 7,283,765 | B2 | 10/2007 | Uratani et al. | |
| 7,310,489 | B2 | 12/2007 | Kawai | |
| 7,457,569 | B2 | 11/2008 | Kawai | |
| 7,555,249 | B2 | 6/2009 | Kawai | |
| 7,848,684 | B2 | 12/2010 | Kawai | |
| 7,865,115 | B2 | 1/2011 | Oguma et al. | |
| 8,045,899 | B2 | 10/2011 | Kawai | |
| 8,180,262 | B2 | 5/2012 | Kawai | |
| 8,208,830 | B2 | 6/2012 | Uratani et al. | |
| 8,249,485 | B2 | 8/2012 | Horikawa et al. | |
| 2002/0191981 | A1 | 12/2002 | Miyabe et al. | |
| 2009/0290904 | A1 | 11/2009 | Kawai et al. | |
| 2010/0221039 | A1 | 9/2010 | Kawai et al. | |
| 2010/0278559 | A1 | 11/2010 | Komatsu et al. | |
| 2011/0229196 | A1 | 9/2011 | Kawai et al. | |
| 2012/0243905 | A1 | 9/2012 | Uratani et al. | |
| 2012/0269540 | A1 | 10/2012 | Kawai et al. | |
| 2013/0022368 | A1 | 1/2013 | Takarada et al. | |
| 2013/0114972 | A1* | 5/2013 | Takarada et al. | 399/110 |
| 2013/0121720 | A1* | 5/2013 | Hoshi et al. | 399/106 |

* cited by examiner

CARTRIDGE WITH MEMBER FOR FIXING A MEMBER-TO-BE-ENERGIZED

FIELD OF THE INVENTION AND RELATED ART

The present invention relates to a cartridge for an image forming apparatus.

In a conventional electrophotographic image forming apparatus, a process cartridge-type in which an electrophotographic photosensitive member and a process means acting on the electrophotographic photosensitive member are integrally assembled into a cartridge which is detachably mountable to an image forming apparatus main assembly is employed (U.S. Patent Application Publication No. US2002/0191981 A1). Here, the electrophotographic image forming apparatus forms an image on a recording material by using an electrophotographic image forming process. The electrophotographic image forming apparatus may include, e.g., an electrophotographic copying machine, an electrophotographic printer (e.g., LED printer, laser beam printer, or the like), an electrophotographic facsimile machine, an electrophotographic word processor, and the like. The process cartridge is prepared by integrally assembling the electrophotographic photosensitive member, a developing device and a charging means or a cleaning means into a cartridge, which is detachably mountable to a main assembly of the electrophotographic image forming apparatus. Further, the developing device is prepared by integrally connecting a developer accommodating portion, in which the developer (toner) is accommodated, and a developing means provided with a developing member into a unit. According to the process cartridge type, maintenance of the image forming apparatus can be performed by a user himself (herself) without relying on a service person, so that operativity was able to be remarkably improved. For this reason, the process cartridge type has been widely used in the image forming apparatus.

In the U.S. Patent Application Publication No. US2002/0191981 A1, an electric energy supply method to a developing blade for regulating an amount of the developer carried on a developing sleeve is described as follows. When a cartridge is mounted to an apparatus main assembly, a developing device contact member provided on a side cover of the cartridge contacts a main assembly contact portion of the apparatus main assembly. The developing device contact contacts a metal spring engaged with a hole provided at a metal plate portion of the developing blade. By a constitution described above, electric energy is supplied from the apparatus main assembly to the developing device contact member, so that a voltage is applied to the developing blade via the metal spring (paragraph [0138]).

In the above-described cartridge, there is a need to fix the developing container contact member on the side cover by clamping or the like, or man-hours for mounting the metal spring to the developing device contact member and the developing blade are generated.

SUMMARY OF THE INVENTION

A principal object of the present invention is to provide a cartridge having a structure capable of realizing improvement in productivity.

According to an aspect of the present invention, there is provided a cartridge detachably mountable to a main assembly of an image forming apparatus, comprising: a frame; a member-to-be-energized; a fixing member, having electroconductivity, for fixing the member-to-be-energized to the frame, wherein the fixing member is electrically connected with the member-to-be-energized; a recessed portion, provided on the frame, where a part of the fixing member enters; and a molded resin portion formed by injecting a melted electroconductive resin material into the recessed portion, wherein when the cartridge is mounted in the main assembly, the molded resin portion electrically connects the fixing member with an energizing portion provided in the main assembly.

These and other objects, features and advantages of the present invention will become more apparent upon a consideration of the following description of the preferred embodiments of the present invention taken in conjunction with the accompanying drawings.

Figure 11:
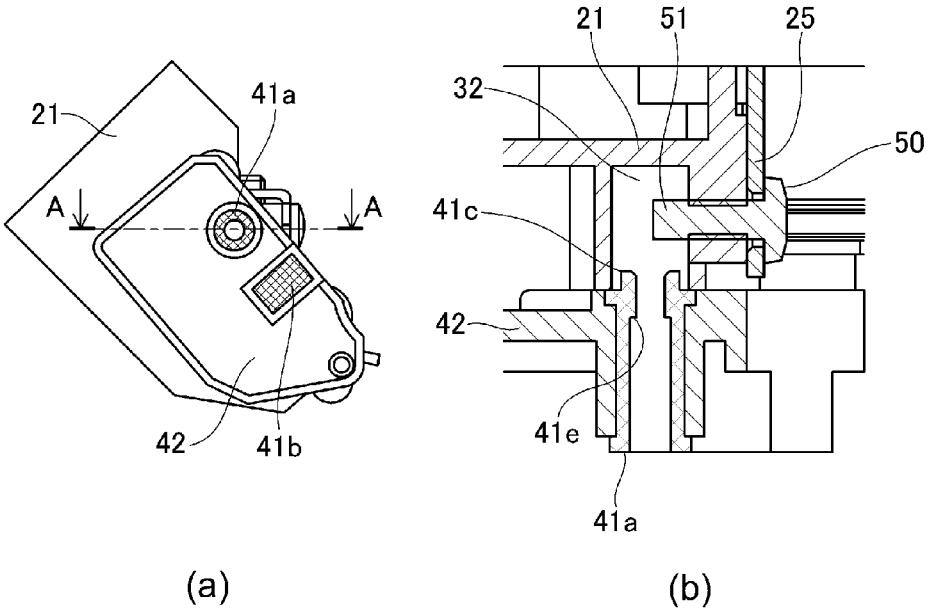

Parts (a) and (b) of FIG. 11 are illustrations of a bearing member in Embodiment 2 of the present invention.

Figure 12:
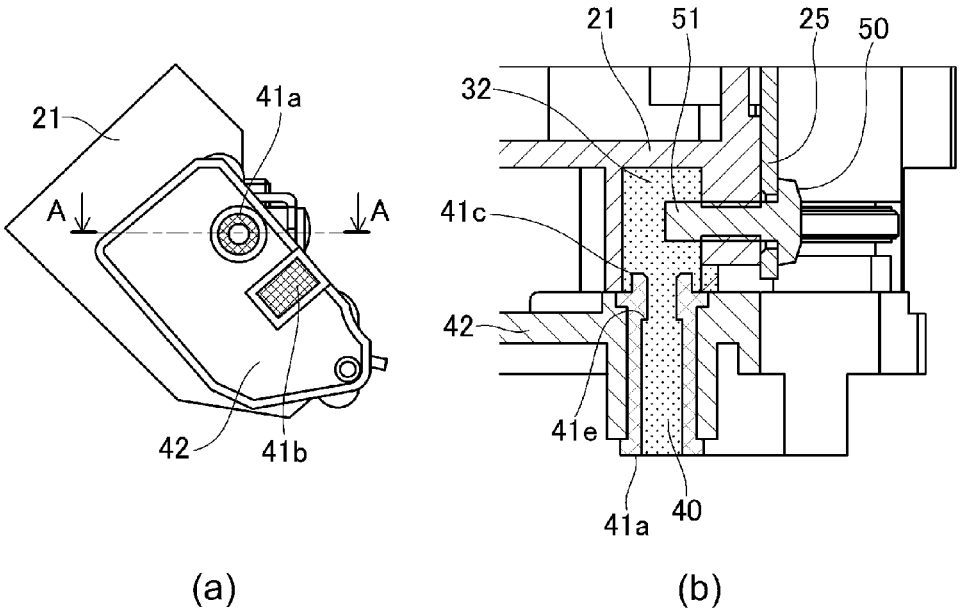

Parts (a) and (b) of FIG. 12 are illustrations of the developing device in Embodiment 2 of the present invention.

DESCRIPTION OF THE PREFERRED EMBODIMENTS

With reference to the drawings, embodiments for carrying out the present invention will be described specifically based on examples. However, dimensions, materials, shapes and relative arrangements of constituent elements (parts) described in the following embodiments should be appropriately modified depending on constitution or various conditions of cartridges or apparatuses to which the present invention is applied. That is, the scope of the present invention is not intended to be limited to that in the following embodiments.

Embodiment 1

Figure 1:
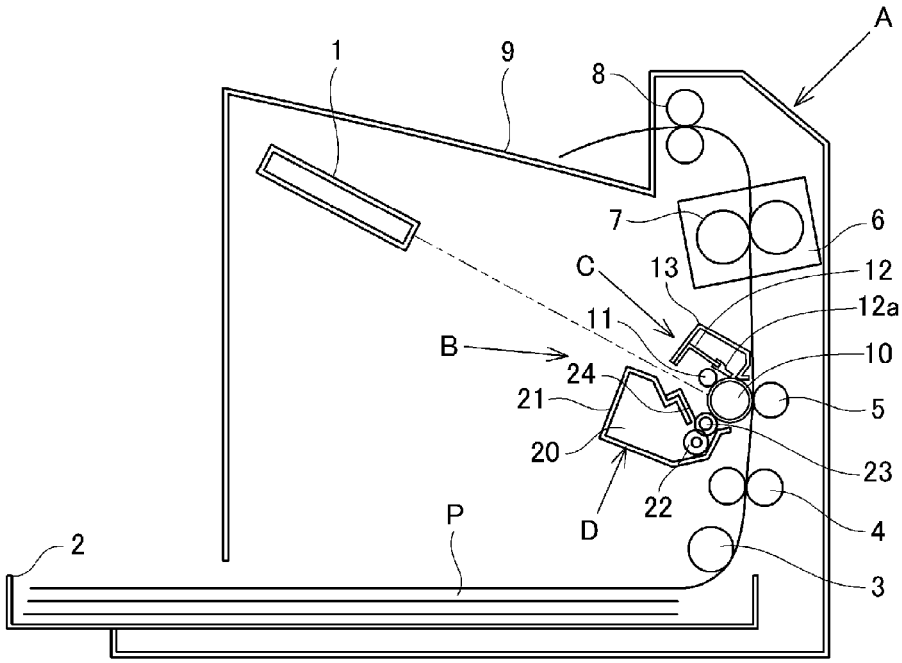
FIG. 1 is a sectional view of an image forming apparatus in Embodiment 1 of the present invention.

With reference to FIG. 1, a schematic general structure of an image forming apparatus will be described along a flow of a recording material (medium) P. FIG. 1 is a schematic sectional view showing a general structure of the image forming apparatus in this embodiment. In an image forming apparatus main assembly A, based on latent image data sent from a scanner portion 1, a latent image is formed on a photosensitive drum 10 as an electrophotographic photosensitive member and then is developed, so that a toner image is formed on the photosensitive drum 10. A sheet feeding cassette 2 capable of accommodating many sheets of the recording material P is provided, and the sheets of the recording material P are fed one by one by a sheet feeding portion 3. The fed recording material P is conveyed to a registration roller 4. The recording material P conveyed by the registration roller 4 is subjected by a transfer roller 5 to transfer of the toner image from the photosensitive drum 10. Then, the recording material P is conveyed into a fixing portion 6 in which the toner image is fixed on the recording material P by a fixing roller 7.

The recording material P after the image fixing is discharged to a sheet discharge portion 9 by a (sheet) discharging portion 8.

[Process Cartridge]

A process cartridge B according to the present invention is prepared by integrally assembling a photosensitive member unit C and a developing unit (developing device) D into a cartridge, which is detachably mountable to the apparatus main assembly A. The photosensitive member unit C includes the photosensitive drum 10, a charging roller 11 as a charging means, a cleaning blade 12 as a cleaning means, and the like. The developing device D includes a developing roller 23 as a developing means, a supplying roller 22, a developing blade 24, a toner accommodating portion 20, a developing container (developing device frame) 21, and the like. In this embodiment, the developing means effects development in the following manner. First, the toner in the toner accommodating portion 20 is supplied to the developing roller 23 as a developer carrying member by rotation of the supplying roller 22, so that an amount of the toner carried on the surface of the developing roller 23 is regulated by the developing blade 24 and thus a toner layer is formed. Then, by transferring the toner onto the photosensitive drum 10 depending on an electrostatic latent image, a toner image is formed to visualize the electrostatic latent image. In this embodiment, the cleaning means removes the (residual) toner, by the cleaning blade 12, remaining on the photosensitive drum 10 after the toner image is transferred from the photosensitive drum 10 onto the recording material P by the transfer roller 5. The cleaning blade 12 scrapes off the residual toner on the photosensitive drum 10 with an elastic blade 12*a* provided so that its edge portion is counterdirectionally contacted to the photosensitive drum 10, thus collecting the residual toner in a cleaning (means) frame 13.

[Developing Unit]

Figure 2:
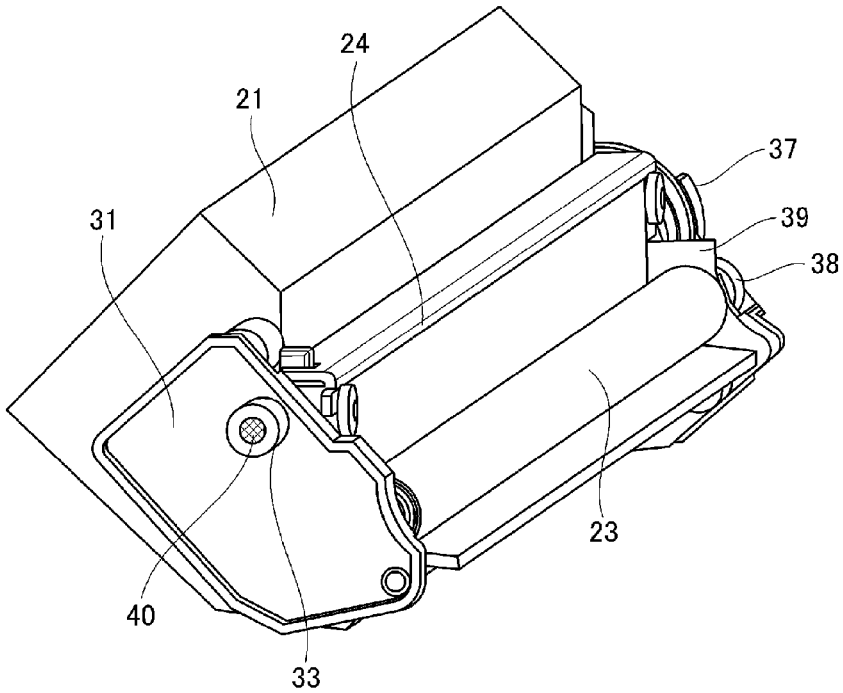
FIG. 2 is an illustration of a developing device in Embodiment 1 of the present invention.
Figure 3:
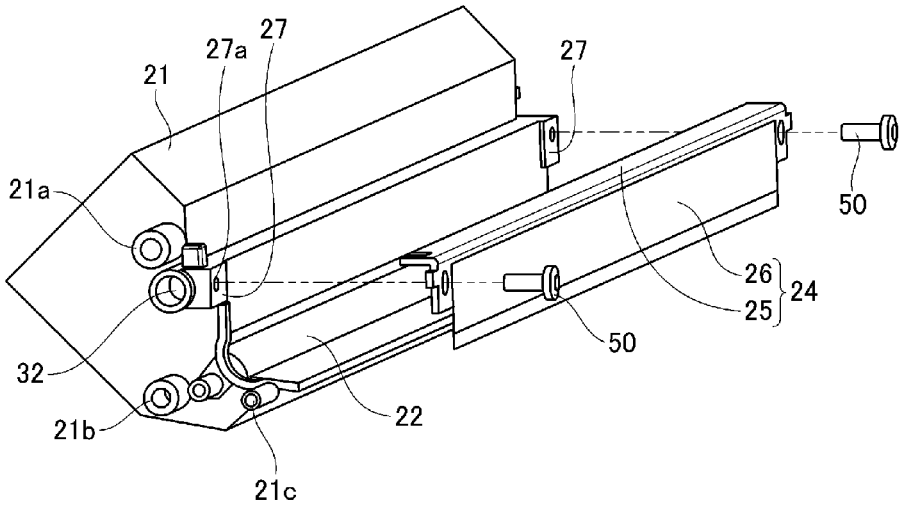
FIGS. 3 to 8 are assembly illustrations of the developing device in Embodiment 1 of the present invention.

With reference to FIGS. 2 and 3, the developing unit (developing device) D according to this embodiment will be described. The developing unit D is, as described above, constituted by the toner, the toner accommodating portion 20 in which the toner is accommodated, the toner supplying roller 22, the developing roller 23, the developing blade 24, and the developing container 21 for accommodating the developing means such as the developing roller 23 or the developing blade 24. The developing blade 24 is constituted by a contact portion 26 contacting the developing roller 23 and a metal-made supporting plate 25 for supporting the contact portion 26. The contact portion 26 is formed with an elastic material such as a rubber material or a thin metal material. In this embodiment and a conventional example, as the contact portion 26, a 0.08 mm-thick stainless steel plate is used. The developing blade 24, constituted by these parts, as a member-to-be-energized (member to which electric energy is to be supplied) is fixed to the developing container 21 as a first frame with screws 50 as a fixing member formed with an electroconductive material. The developing roller 23 and the supplying roller 22 are supported by a bearing member 31 as a second frame. Incidentally, the developing unit D may be one constituting a part of the above-described process cartridge and may also be one independently detachably mountable to the electrophotographic image forming apparatus main assembly.

Constitution of this Embodiment

With reference to FIGS. 2 to 8, a constitution of the developing device according to Embodiment 1 will be described. In the following, particularly, a connecting method of the bearing member 31 and a constitution regarding an electric path for applying a voltage to the developing blade 24 will be specifically described together with a sequence of an assembling operation of the developing blade 24 and the bearing member 31. FIG. 2 is a perspective view of the developing unit in this embodiment. Further, FIG. 3 to FIG. 8 are assembly illustrations of the developing unit according to this embodiment and show a developing unit assembling state in the order of the figures. Description will be made from assembling of parts with the developing container 21 in a state in which filling of the toner and assembling of the supplying roller or the like are completed.

Figure 4:
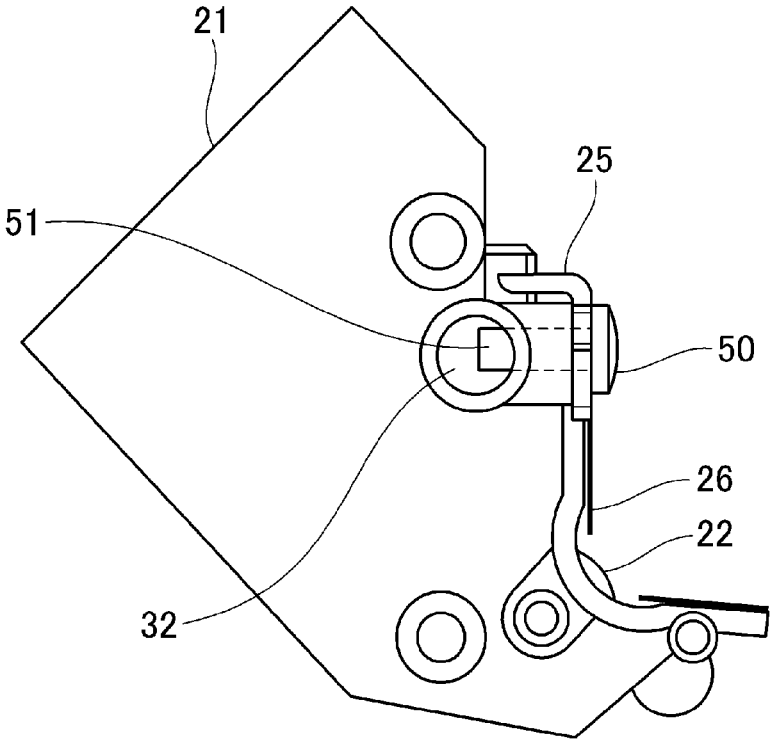

(1) Assembling of Developing Blade (FIGS. 3 and 4)

FIG. 3 is an exploded perspective view showing the developing container 21 and the developing blade 24 in a disassembling state. FIG. 4 is a side view showing a state in which the developing blade 24 is mounted to the developing container 21 but the bearing member 31 is not mounted to the developing container 21. First, the developing blade 24 is fixed, with the screws 50, to mounting bearing surfaces 27 provided on the developing container (first frame) 21 at two positions. In this case, a screw hole 27*a* at one of the bearing surfaces 27 extends to a recessed portion 32 as a connecting portion provided at a connecting surface with the bearing member 31 on the developing container 21. At a position where clamping with the screw 50 is completed, as shown in FIG. 4, a screw end portion 51 is in a state in which it is projected to a space of the recessed portion 32.

Figure 5:
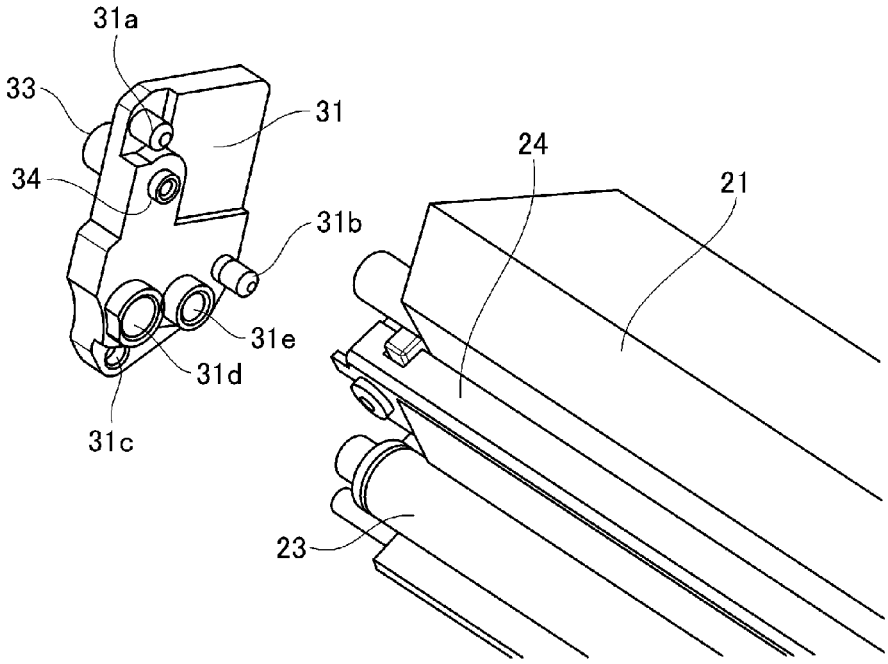
Figure 6:
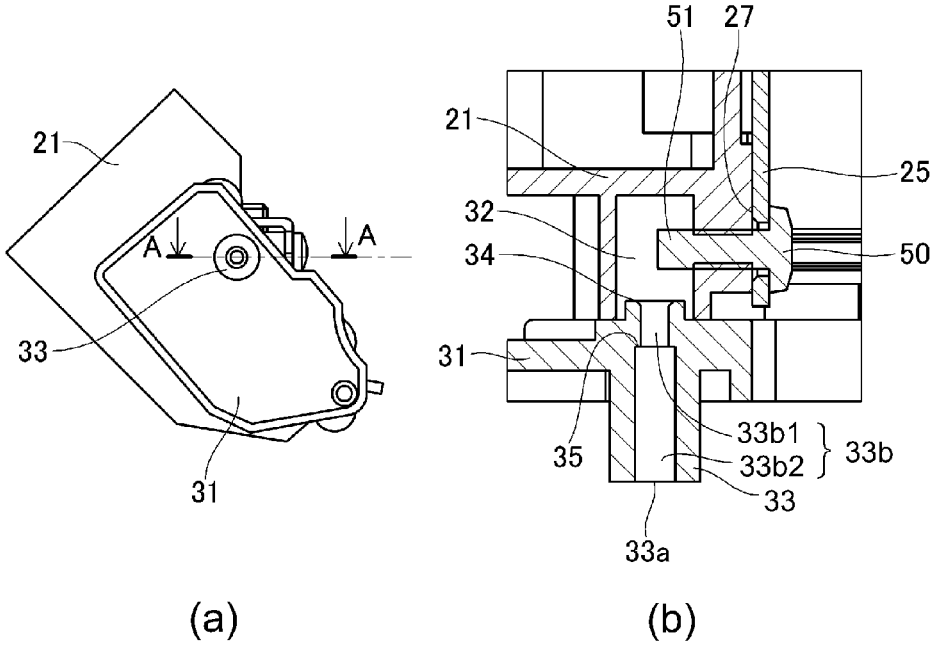

(2) Assembling of Bearing Member (FIG. 5 and (a) and (b) of FIG. 6)

FIG. 5 is a perspective view showing a state before the bearing member is mounted to the developing container. Part (a) of FIG. 6 is a side view of the developing unit in a state in which the bearing member 31 is mounted, and (b) of FIG. 6 is a sectional view of the developing unit taken along A-A line in (a) of FIG. 6 and shows a cross section particularly in the neighborhood of an injecting portion 33. The bearing member 31 includes a bearing portion 31*d* for shaft-supporting a shaft end portion of the developing roller 23, a bearing portion 31*e* for shaft-supporting the supplying roller 22, positioning portions 31*a*, 31*b* and 31*c* for positioning the bearing member 31 relative to the developing container 21, and the injection port 33 for permitting injection of a melted resin material. As a material for the bearing member 31, a resin material (e.g., polyacetal resin) excellent in sliding property is used. The injecting portion 33 includes an injection port 33*a*, a resin flow passage portion 33*b*1, a resin flow passage portion 33*b*2 having a larger diameter than the resin flow passage portion 33*b*1, a stepped portion 35 between the resin flow passage portions 33*b*1 and 33*b*2, and an injection nozzle portion 34. All the structures from the injection port 33*a* to the injection nozzle portion 34 constitute a flow passage of the melted resin material and penetrate through the bearing member 31 to form the resin flow passage portions 33*b*1 and 33*b*2 which constitute a communication hole 33*b*. A filling space of the resin material is formed (defined) by such a flow passage, the recessed portion 32 and the screw end portion 51 of the screw 50 projected toward or exposed to the inside of the recessed portion 32. Assembling of the bearing member 31 with the developing container 21 is performed by engaging the positioning portions 31*a*, 31*b* and 31*c* of the bearing member 31 with positioning portions 21*a*, 21*b* and 21*c* (FIG. 3) of the developing container 21, respectively. At this time, the injection nozzle portion 34 is in a state in which it is incorporated in the recessed portion 32 of the developing container 21.

(3) Connection of Bearing Member (FIGS. 7 and 8) (Injection of Electroconductive Resin Material)

Figure 7:
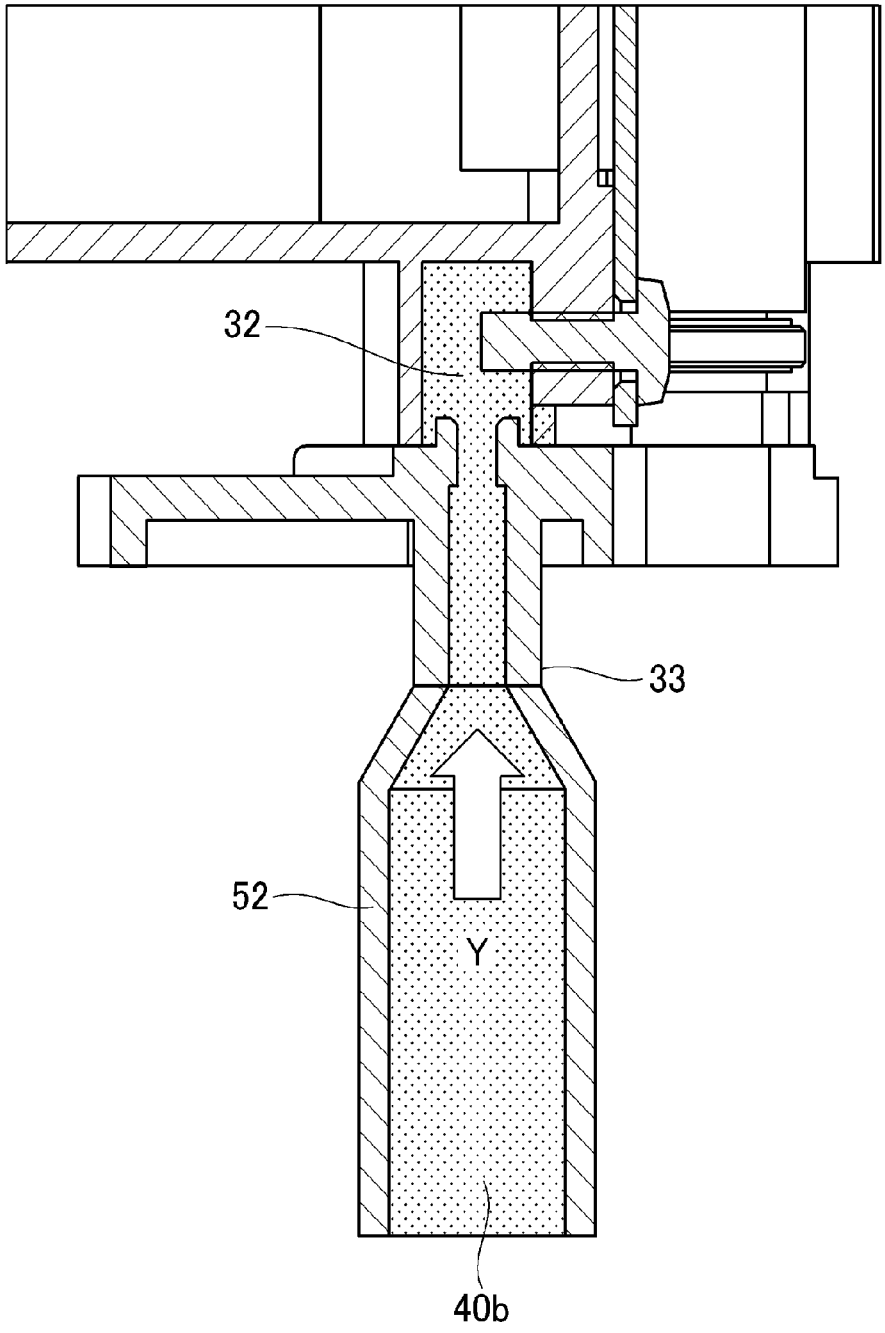
Figure 8:
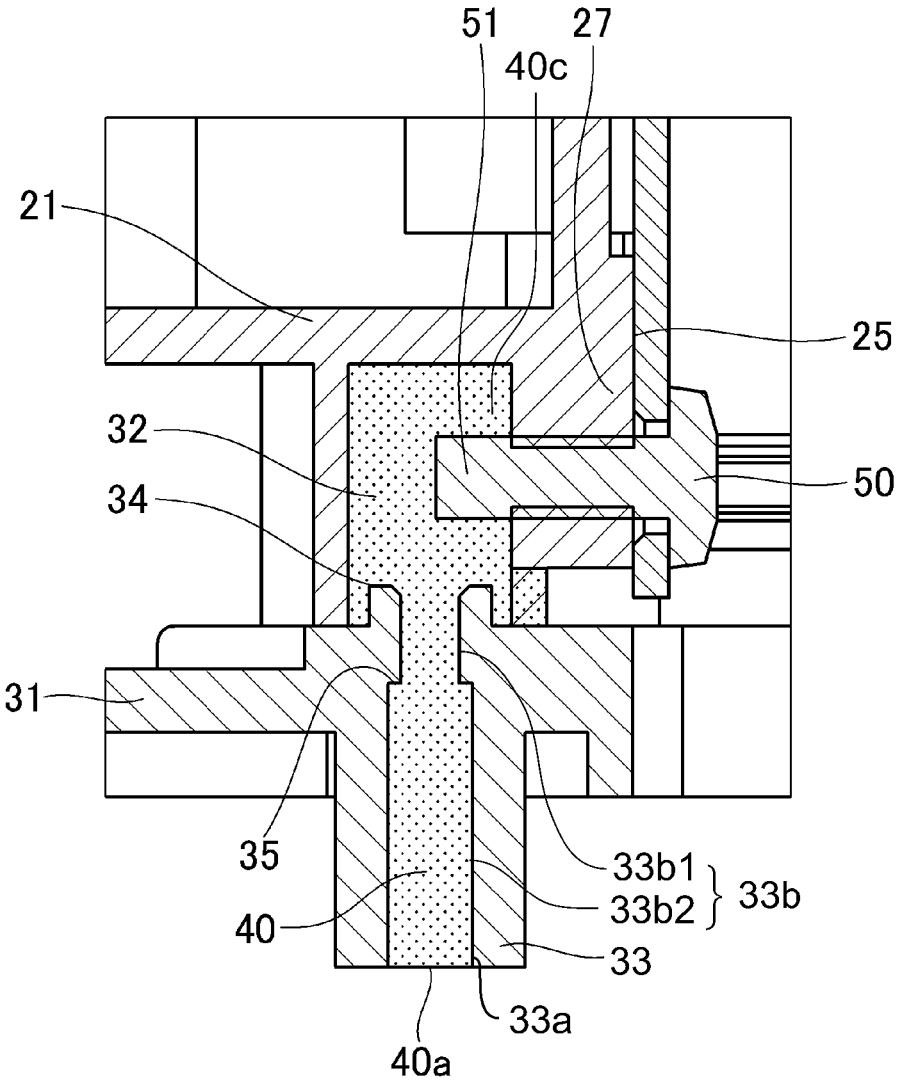

FIG. 7 is a schematic sectional view showing a state of injection of an electroconductive resin material. FIG. 8 is a schematic sectional view showing a periphery of a molded resin portion (after molding). A nozzle end portion 52 of a resin injecting device is contacted to the injection port 33*a*, and then the melted electroconductive resin material 40*b* (dotted portion) is injected in an appropriate amount into the space of the recessed portion 32. The resin material flows in an arrow Y direction. The injected electroconductive resin material 40*b* is solidified (hardened) immediately after the injection to form a molded resin portion 40, so that a connecting operation of the bearing member 31 to the developing container 21 is completed (FIG. 7). As shown in FIG. 8, a portion where the molded resin portion 40 is formed by injecting the resin material into the entire region of the recessed portion 32 is connected with the screw 50 by cooling and solidification of the resin material at a full circumference of the screw end portion 51. This is because the screw end portion 51 functions as a retaining stopper for the molded resin portion 40. That is, the screw 50 is connected with the developing container 21 and therefore an engaging portion 40*c* of the molded resin portion 40 is engaged with the screw end portion 51, so that the molded resin portion 40 is also in a fixed state to a developing device frame 21. On the other hand, of the molded resin portion 40, a portion in the neighborhood of the stepped portion 35 of the bearing member 31 is molded in a stepped shape. The stepped shape functions as a stopper for preventing disconnection of the bearing member 31 in a direction opposite to an assembling direction.

In summary, with respect to the direction perpendicular to the axis of the communication hole 33*b*, the size of the cross section, in the recessed portion 32 side, of the communication hole 33*b* for establishing communication between the recessed portion 32 and the injection port 33*a* is configured to be narrower than the size of the cross section of the communication hole 33*b* in the injection port side and the size of the cross section of the recessed portion 32. As a result, the molded resin portion 40 is fixed to the developing container 21 to form a state in which the molded resin portion 40 is not disconnected from the bearing member 31 and therefore the connection of the bearing member 31 to the developing container 21 is made.

The electroconductive resin material 40*b* is slightly contracted when it is cooled and solidified. By using this phenomenon, the resin material around the screw 50 and the resin material between the screw 50 and the stepped portion 35 are contracted, i.e., the resin material present between the two stoppers is contracted, so that the stoppers are placed in a state in which they pull at each other. As a result, adhesiveness between the bearing member 31 and the developing device frame 21 is enhanced, so that a fixed state with no play (clearance) can be maintained. Particularly, the screw 50 is configured to be projected into the filling space with respect to the direction (crossing direction) substantially perpendicular to the direction in which the communication hole 33*b* extends, so that a further strong fixed state can be formed.

As described above, the connection between the developing container 21 and the bearing member 31 is made by the molded resin portion 40 formed by the solidification of the electroconductive resin material 40*b* injected into the recessed portion 32. Concurrently with this connection, also an electric path (conduction path) from the developing blade supporting metal plate 25 to the molded resin portion 40 is formed by the contact between the developing blade supporting metal plate 25 and the metal-made screw 50 and by the contact between the screw 50 and the molded resin portion 40. In this case, when the electroconductive resin material 40*b* moved to the full circumference of the screw end portion 51 is cooled and solidified the contraction occurs similarly as in the above-described case and thus the molded resin portion 40 intimately contacts the screw 50, so that a stable contact pressure can be generated. Therefore, a reliable (electric) conduction performance between the screw and the molded resin portion 40 can be maintained.

In this embodiment, as the electroconductive resin material, a polyacetal resin material containing about 10% of carbon black is used. The reason why carbon black is used is that damage (abrasion or the like) to a manufacturing apparatus is minimized, but carbon fiber or another metal-based additive may also be used.

By using the electric path formed as described above, an energization contact (not shown) of the image forming apparatus main assembly is contacted to an injection end (contact portion) 40*a* of the molded resin portion 40, so that it becomes possible to apply a voltage to the developing blade 24. Thus, according to the present invention, the fixed portion of the bearing member functions as the electric path for applying the voltage to the developing blade, so that compared with a conventional developing unit using a metal-made contact member, it is possible to realize cost reduction of the contact member and improvement in productivity. Further, the connected portion (fixed portion) of the bearing member and the electric path are formed at the same position, so that space saving can be realized.

Embodiment 2

With reference to FIGS. 9 to 12, a developing device according to Embodiment 2 will be described. In this embodiment, only a difference from Embodiment 1 will be described, and matters which are not described are common to Embodiments 1 and 2. In this embodiment, a constitution in which an area of the contact surface contacting the energization contact of the main assembly was ensured so as to be larger than that in Embodiment 1 was employed. This constitution is one of general constitutions necessary in the case where the developing device is swung relative to the developing device in the image forming apparatus main assembly in order to space the developing roller from the photosensitive drum during non-image formation for the purpose of preventing deterioration of the developer by the rotation of the developing roller. Specific description of the swing constitution is well known in the conventional constitution and therefore will be omitted, but along a locus of the swing of the developing device, the energization contact of the image forming apparatus main assembly and the contact surface contacting the energization contact are required to always contact each other continuously. Therefore, there is a need to ensure an area of the contact surface. Further, the contact surface is also required to be smooth since the contact surface slides with the energization contact.

Figure 9:
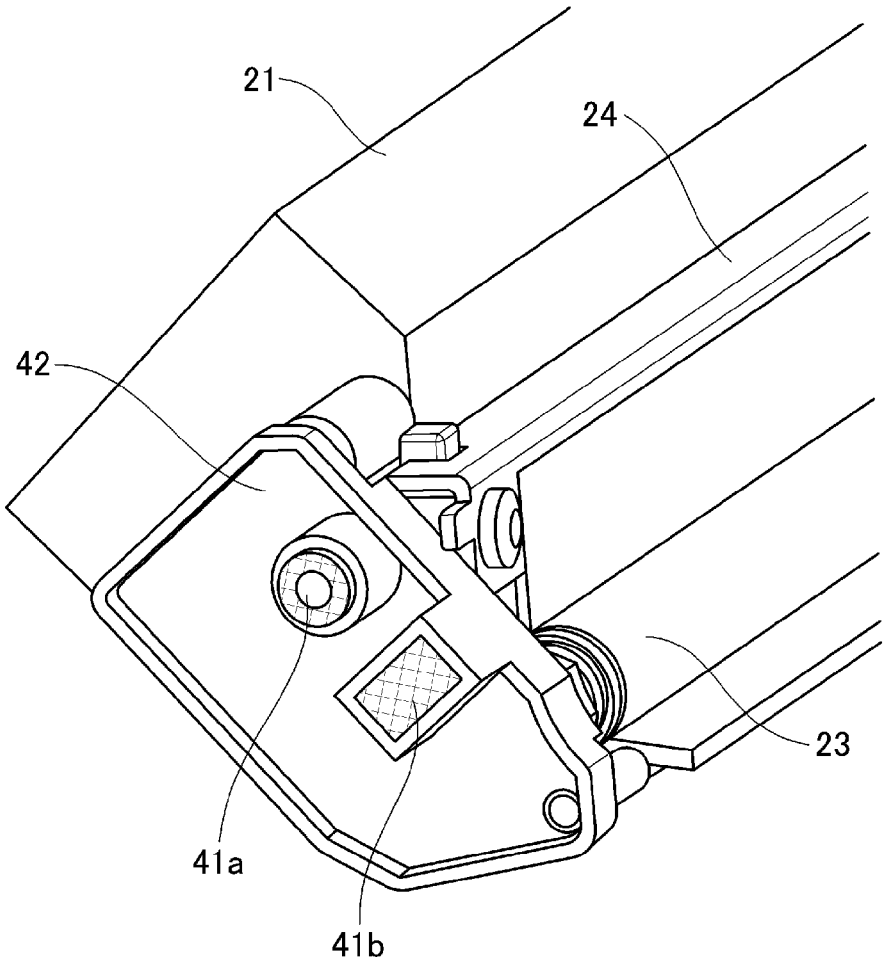
FIG. 9 and (a) and (b) of FIG. 10 are illustrations of a developing device in Embodiment 2 of the present invention.

FIG. 9 is an illustration of the developing device according to this embodiment and is a perspective view showing a structure of a bearing member 42 and its periphery. In this embodiment, as shown in FIG. 9, the bearing member meeting the case where the contact surface 41*b* as a cartridge-side contact portion to be contacted to the main assembly energization contact is required to be smooth and to have an area to some extent was used.

Figure 10:
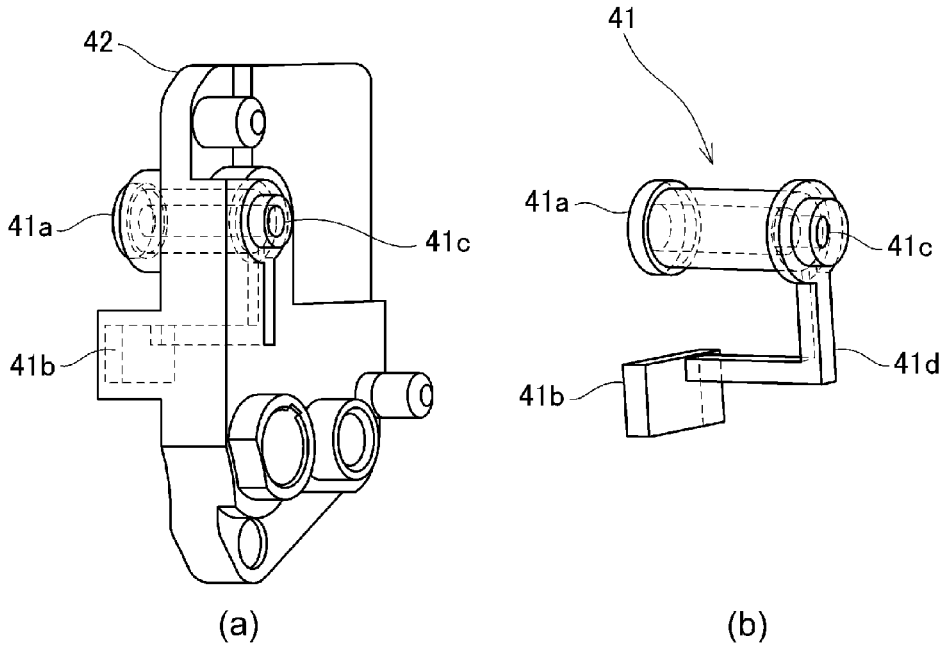

A constitution of the bearing member 42 will be described with reference to (a) and (b) of FIG. 10. Parts (a) and (b) of FIG. 10 are illustrations of the bearing member 42 in this embodiment, in which (a) of FIG. 10 is a perspective view of the bearing member 42 and (b) of FIG. 10 is a perspective view showing only the contact position 41 after the molding. In this embodiment, the bearing member 42 is formed by conjection (two-color) molding using two types of resin materials. The bearing member 42 is prepared by first molding a body portion of the bearing member 42 with the resin material, having the good sliding property, which is the same as that in Embodiment 1, and subsequently by molding the contact portion 41 with the electroconductive resin material part (b) of FIG. 10 shows only the contact portion 41. The contact portion 41 includes a contact surface 41*b* which is smooth and ensures a sufficient area where it contacts the main assembly contact, an injection port 41*a* having a shape similar to that of the bearing member 31 in Embodiment 1, a stepped portion 41*e*, an injection nozzle portion 41*c*, and a connecting portion 41*d*, for connecting these portions, formed integrally with these portions. The contact portion 41 is formed with the electroconductive resin material and therefore is capable of ensuring electric condition at any portion.

Parts (a) and (b) of FIG. 11 are illustrations of the developing device according to this embodiment of the present invention, in which (a) of FIG. 11 is a side view of the developing unit, and (b) of FIG. 11 is a sectional view taken along A-A line in (a) of FIG. 11 and shows a state of the electroconductive resin material before injection. Parts (a) and (b) of FIG. 12 are illustrations of the developing device according to this embodiment of the present invention, in which (a) of FIG. 12 is a side view of the developing unit, and (b) of FIG. 12 is a sectional view taken along A-A line in (a) of FIG. 12 and shows a state of the electroconductive resin material after the injection. The connection of the bearing member 42 to the developing container 21 is effected similarly as in Embodiment 1. As shown in FIG. 11, by assembling the bearing member 42 with the developing container 21 to which the developing blade 24 is mounted by the screw 50, the recessed portion 32 is formed. Then, the electroconductive resin material is injected from the injection port 41*a*, so that the connection of the bearing member 42 to the developing container 21 is completed (FIG. 12). The molded resin portion 40 and the contact portion 41 are formed with the same electroconductive resin material. Therefore, the electric path is formed from the contact portion 41*b* in the order of the connecting portion 41*d*, the nozzle-shaped portion (injection nozzle portion) 41*c*, the molded resin portion 40, the screw 50, and the supporting metal plate 25 for the developing blade 24. As a result, the voltage can be applied from the main assembly contact to the developing blade 24.

As described above, by the connecting method, between the bearing member and the contact structure, meeting the case where the developing device is swung, it is possible to concurrently realize the connection of the bearing member and the formation of the electric path at the same position. Also in this embodiment, similarly as in Embodiment 1, compared with the conventional developing unit using the metal-made contact member, it is possible to realize the cost reduction of the contact member and the scope saving by formation of the connected portion (fixed portion) of the bearing member and the electric path at the same position.

Both in Embodiments 1 and 2, an example in which the bearing member constitution in the present invention is applied to the developing device is shown but a constitution to which the present invention is applicable is not limited thereto. For example, the constitution is applicable to also a photosensitive member unit including the photosensitive drum, the bearing member for shaft-supporting the photosensitive drum, the cleaning blade (cleaning member), the cleaning (member) frame, and a cover member provided at a side surface of the cleaning frame. Further, the constitution is similarly applicable to also a process cartridge including both of the developing device and the photosensitive member unit described above.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 270184/2011 filed Dec. 9, 2011 and 243467/2012 filed Nov. 5, 2012, which are hereby incorporated by reference.

What is claimed is:

1. A cartridge detachably mountable to a main assembly of an image forming apparatus, said cartridge comprising:

a frame;

a member-to-be-energized;

a fixing member, having electroconductivity, for fixing said member-to-be-energized to said frame, wherein said fixing member is electrically connected with said member-to-be-energized;

a recessed portion, provided on said frame, where a part of said fixing member enters; and a molded resin portion formed by injecting a melted electroconductive resin material into said recessed portion, wherein when said cartridge is mounted in the main assembly, said molded resin portion electrically connects said fixing member with an energizing portion provided in the main assembly.

2. A cartridge according to claim 1, wherein said fixing member includes a projection projected into said recessed portion.

3. A cartridge according to claim 2, wherein said molded resin portion includes an engaging portion engaged with said projection to prevent said fixing member from being detached from said recessed portion.

4. A cartridge according to claim 1, further comprising a second frame mounted to said frame, wherein said second frame is provided with an injection port through which the resin material is to be injected.

5. A cartridge according to claim 4, wherein a contact portion to which said energizing portion is to be contacted is exposed from said injection port.

6. A cartridge according to claim 4, wherein said second frame is provided with a communication port for connecting said recessed portion and said injection port.

7. A cartridge according to claim 6, wherein a size of cross section of said communication port perpendicular to an axis of said communication port is smaller in a recessed portion side than in an injection port side with respect to a direction of the axis of said communication port.

8. A cartridge according to claim 1, further comprising a second frame mounted to said frame, wherein a contact portion to which said energizing portion is to be contacted is exposed from said second frame.

9. A cartridge according to claim 1, wherein said member-to-be-energized is a regulating member for regulating an amount of a developer carried on a developer carrying member formed on a photosensitive member.

10. A cartridge according to claim 1, wherein said member-to-be-energized is a cleaning member for removing the developer from a surface of a photosensitive member.

* * * * *